United States Patent [19]

Schwing

[11] 4,019,839

[45] Apr. 26, 1977

[54] DISTRIBUTING VALVES FOR VISCOUS MATERIALS

[75] Inventor: Friedrich Schwing, Wanne-Eickel, Germany

[73] Assignee: Friedrich Wilhelm Schwing GmbH, Wanne-Eickel, Germany

[22] Filed: Mar. 27, 1975

[21] Appl. No.: 562,580

[30] Foreign Application Priority Data

Mar. 29, 1974 Germany ..... 2415276

[52] U.S. Cl. ..... 417/517; 417/519; 417/900

[51] Int. Cl.[2] ..... F04B 15/02; F04B 39/10

[58] Field of Search ..... 417/517, 518, 519, 531, 417/900, 532

[56] References Cited

UNITED STATES PATENTS

| | | | |
|---|---|---|---|
| 3,331,332 | 7/1967 | Wennberg | 417/900 |
| 3,398,693 | 8/1968 | Schumann | 417/507 |
| 3,647,326 | 3/1972 | Bille | 417/900 |
| 3,877,847 | 4/1975 | Bille | 417/900 |

FOREIGN PATENTS OR APPLICATIONS

| | | | |
|---|---|---|---|
| 1,953,450 | 5/1971 | Germany | 417/900 |

*Primary Examiner*—Carlton R. Croyle
*Assistant Examiner*—G. P. LaPointe
*Attorney, Agent, or Firm*—Andrus, Sceales, Starke & Sawall

[57] ABSTRACT

A distributing valve for twin cylinder pumps for pumping viscous materials such as concrete, has an oscillating body with closing elements, for the suction orifices and pressure orifices for the pump cylinders mounted on a shaft disposed outside the part of the pump casing acted upon by the pump pressure. The closing elements are arranged on the same side of the rotating shaft and a pair of closing elements is provided either for the suction orifices or for the pressure orifices.

14 Claims, 9 Drawing Figures

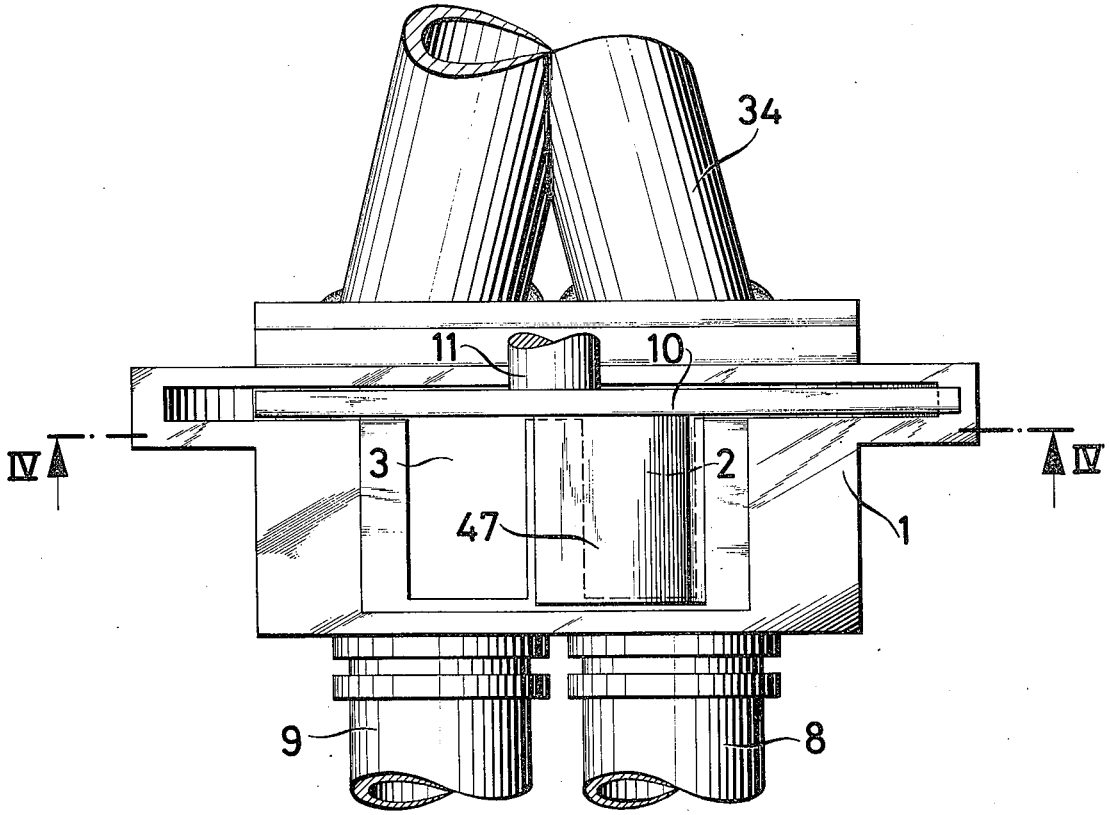
FIG. 3
FIG. 4
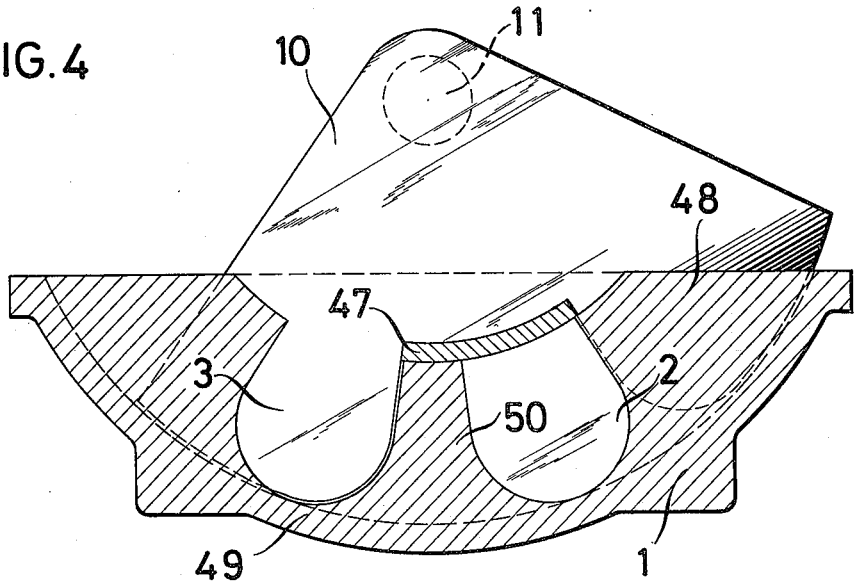

FIG. 5
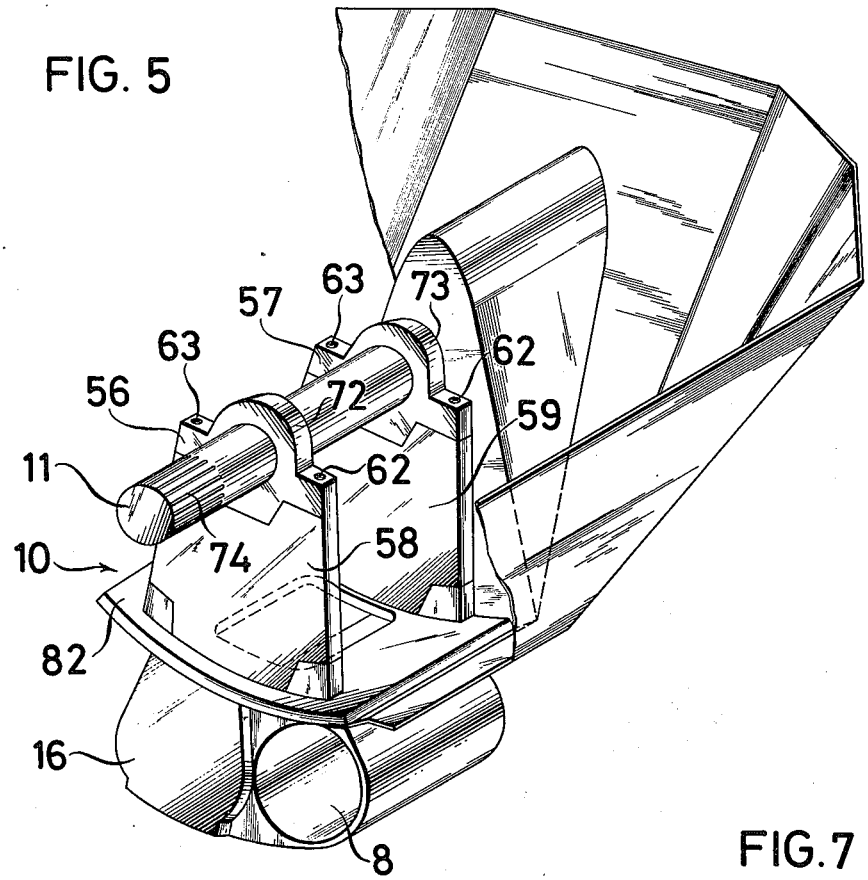
FIG.7
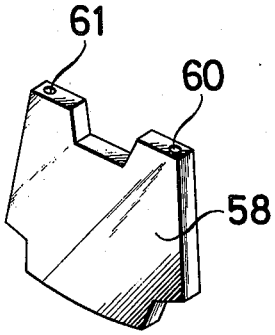
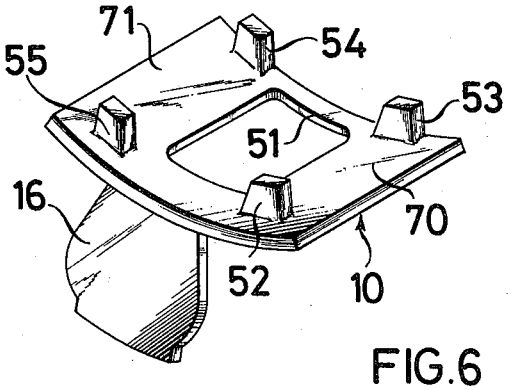
FIG.6

DISTRIBUTING VALVES FOR VISCOUS MATERIALS

BACKGROUND OF THE INVENTION

This invention relates to a distributing valve for viscous materials, particularly twin cylinder pumps supplying concrete, said valve having a shaft in a casting which can be acted upon at least partially by the pump pressure, for moving an oscillating body with locking elements, which open a suction orifice for one pump cylinder and a pressure orifice for the other pump cylinder in one position of the oscillating body and are arranged to close the pressure orifice of the sucking cylinder and the suction orifice of the compressing cylinder. Such a valve will hereinafter be referred to as a valve of the type specified.

In concrete pumps the casing is usually arranged below a preliminary feed receptacle, into which the concrete is introduced, for example, by means of a conveyor mixer. One of the pistons of the pump sucks the concrete out of the preliminary feed receptacle into the appropriate cylinder, while the other piston forces the concrete sucked in during the previous stroke out of the other cylinder into a pipe. In general the casing has two pushing orifices arranged adjacent one another for the attachment of a Y pipe, to the other end of which a conveyor pipe for conveying the concrete is attached.

However the construction of the distributing valve should be such that in each position of the oscillating body, one cylinder has its suction orifice open and its pressure orifice closed while the reverse is true for the corresponding orifices of the other cylinder.

In a known distributing valve of the type specified, this requirement is fulfilled by arranging for the axis of rotation of the shaft to be roughly in the middle of the casing and by arranging that, in one of the two control positions, which are on diametrically opposite sides of the axis of the shaft, the suction orifice of one pump cylinder and the pressure orifice of the other pump cylinder are closed while the pressure orifice of the one and the suction orifice of the other pump cylinder are simultaneously open. In the other control position the functions are reversed. The disadvantage of this known method of construction lies in the problems of sealing and the problems of the resulting wear on the rotating shaft, which must lie within the part of the casing which is under pressure.

SUMMARY OF THE PRESENT INVENTION

The basic object of the invention is to provide a distributing valve of the type specified in which wear on the shaft, particularly on its bearings, is avoided or at least substantially reduced.

According to the invention, there is provided a distributing valve for viscous materials, particularly twin cylinder pumps supplying concrete, said valve having a casing acted upon at least partially by the pump pressure containing a shaft for moving an oscillating body with closing elements, which open a suction orifice for one pump cylinder and a pressure orifice for the other pump cylinder in one position of the oscillating body and are arranged to close the pressure orifice of the sucking cylinder and the suction orifice of the compressing cylinder, the shaft being disposed outside the part of the casing acted upon by the pump pressure, the closing elements being arranged on the same side of the rotating shaft and a pair of closing elements being provided either for the suction orifices or for the pressure orifices.

Since the oscillating shaft lies outside the pressure area, there are no problems of sealing, so that the problems of resulting wear of the oscillating shaft are likewise overcome. Simultaneous closing of a pressure orifice of one supply cylinder and opening of the suction orifice of the same cylinder is achieved by the provision of either a pair of closing elements for the suction orifice or a pair of closing elements for the pressure orifice. This constitutes a negligible increase in expenditure compared to the benefit of solving the problem of sealing at the axis of rotation.

Naturally the expense of construction is at its lowest when, depending on which is provided with a pair of closing elements, either the suction orifice or the pressure orifice has only one closing element.

The closing element or elements for the suction orifice are usefully formed as plates or parts of a plate and curved at a radius from the axis of the oscillating shaft.

On the other hand the closing element or elements for the pressure orifices can be formed as flat plates and can be connected to a plate serving as the closing element or elements for the suction orifice, or formed integrally therewith.

In one embodiment of the invention, the oscillating shaft can be mounted only on one side and arranged in a swing bearing.

It is even more useful if the rotating shaft is mounted on the side members of the casing, which members lie outside the space which is under pressure from the pumps. The shaft bearings are then arranged on two opposite sides of the above-mentioned preliminary feed receptacle.

During operation, the closing elements of the oscillating body are subject to a comparatively higher wear than its remaining members. According to a further embodiment of the invention the oscillating body for connection to the oscillating shaft is divided up into the plate or plates forming the closing elements and at least one support plate having a releasable spacing member. After releasing the spacing member the plate or plates can be easily removed and replaced without the oscillating shaft having to be dismantled.

BRIEF DESCRIPTION OF THE DRAWING

The details and further features of the invention are shown from the following description of several embodiments with reference to the accompanying drawings, in which:

FIG. 3 is a plan view of a part of the pump similar to that shown in FIG. 1 but with an alternative oscillating body, FIG. 4 is a section along the line IV—IV of FIG. 3, FIG. 5 is a perspective view of another embodiment of the invention, FIG. 6 is a perspective view of an interchangeable closing member of a distributing valve according to FIG. 5, FIG. 7 is a perspective view of one of the spacing members in the distributing valve according to FIG. 5.

In the drawings the same reference symbols are used for corresponding members of the various embodiments.

DESCRIPTION OF THE PREFERRED EMBODIMENT

Figure 1:
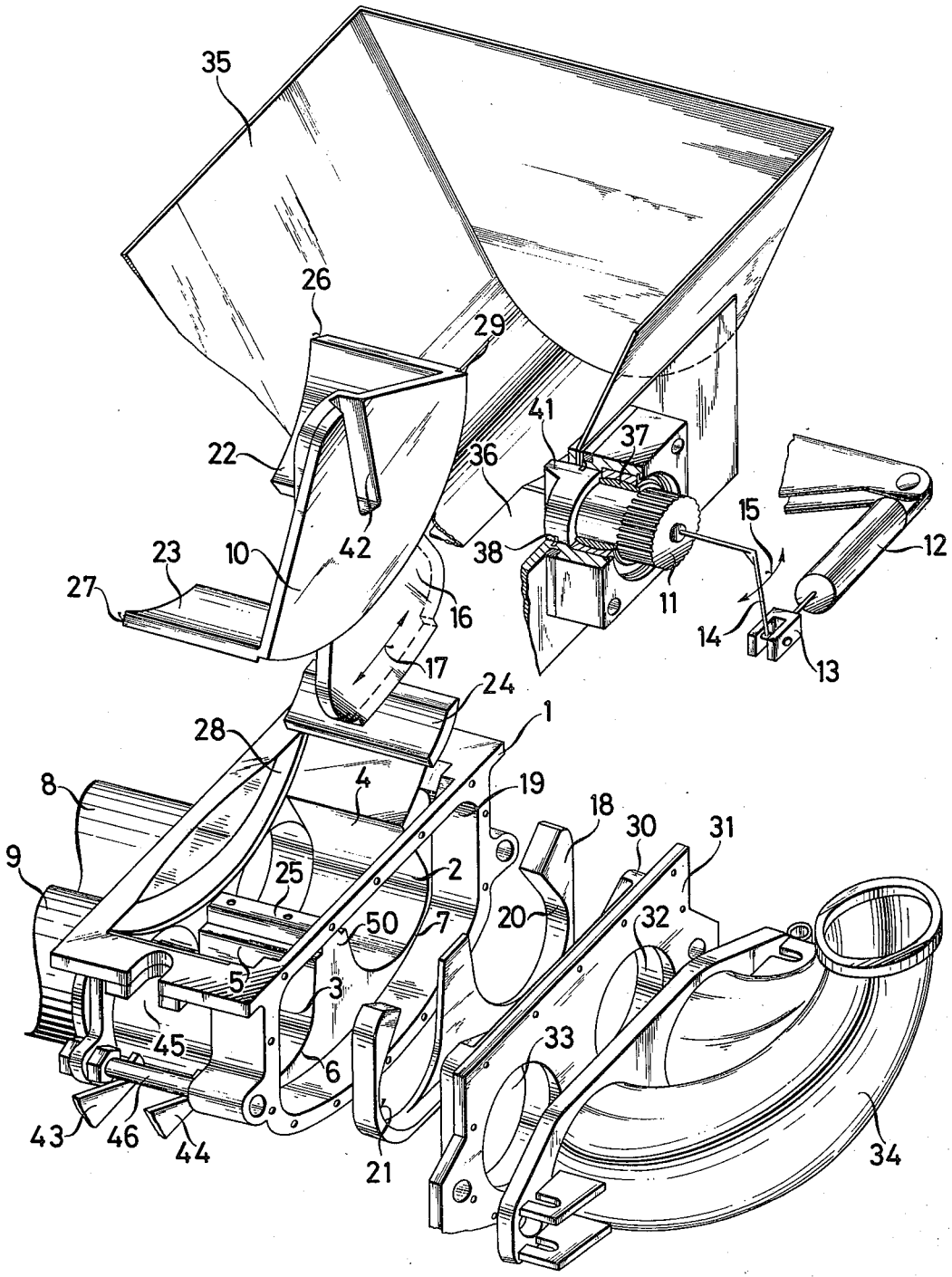
FIG. 1 is an exploded perspective view in partial section of a distributing valve for a concrete pump according to the invention and of the members cooperating therewith.
Figure 2:
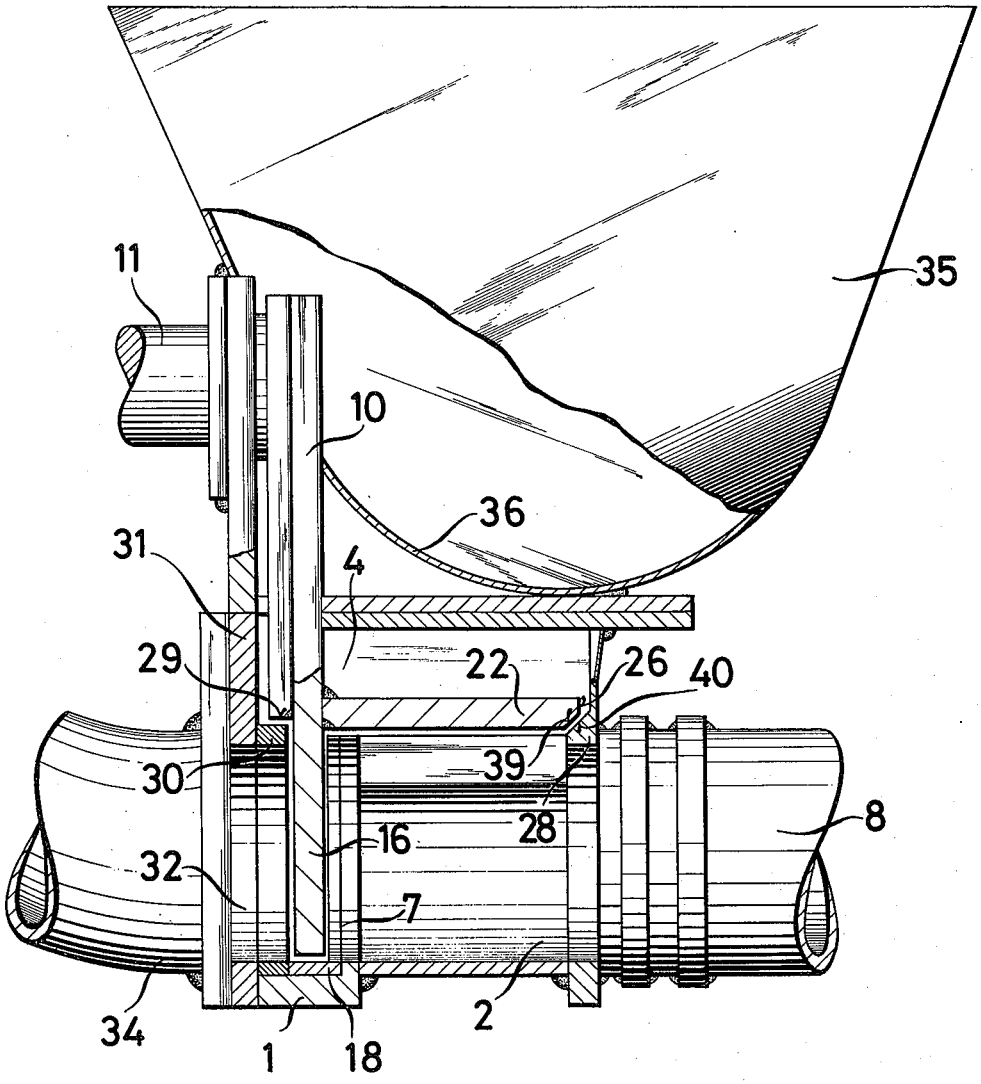
FIG. 2 is a side view in partial section of the pump according to FIG. 1.

In FIGS. 1 and 2 a casing member 1 is under pressure from the supply cylinder 8 and 9, to which it is attached. This casing member has two passages 2 and 3, which have radial suction orifices 4 and 5 and axial pushing orifices 6 and 7.

An oscillating body 10 controls the inlet or outlet of the passages 2 and 3. The oscillating body 10 is coupled to an oscillating shaft 11, which is moved by a thrust piston drive 12 through a hinge 13 and a lever 14 according to the double arrow 15.

In FIGS. 1 and 2, the supply cylinders 8 and 9 are shown coaxial with the passages 2 and 3 respectively. It is possible, however, to install curved pipe elements between the end of the supply cylinders and the distributing valve according to the invention. Then the axis of the rotating shaft 11 forms an angle with the axes of the supply cylinders, determined by the angle of such curved pipe elements.

The oscillating body 10 has a closing element in the form of a plate 16. The plate 16 moves in a plane perpendicular to the axis of the oscillating shaft 11 as shown by the arrow 17 so that it covers and closes one or other of the two outlet orifices 6 and 7 according to the movement of the oscillating body 10. The plate 16 moves in a wear insert 18. The latter is arranged in a recess 19 on the front of the casing 1, which contains the outlet orifices 6 and 7. The wear insert 18 has stops 20 and 21 to limit the movements of the plate 16 and thus of the oscillating body 10.

The oscillating body 10 has two further closing elements in the form of two curved segments 22 and 23 arranged concentric with the axis of rotation, one at each end of the plate 16. Each of the suction orifices 4 or 5 respectively can be covered by one of these segments 22 and 23. The segments 22 and 23 have a uniform radius of curvature around the axis of the oscillating shaft 11. They slide on wear inserts 24 or on a sealing edge 25 in recesses in the casing 1, during movement of the oscillating body 10. The wear inserts 24 and the sealing edge 25 form the seal for a partition wall 50 between the two passages 2 and 3. The front edges 26 and 27 of the segments 22 and 23 slide on a guide surface 28 arranged on the casing 1, said surface being concentric to the axis of the oscillating shaft 11.

The oscillating body 10 has a surface 29 which is concentric to the axis of the oscillating shaft 11 and which slides on a wear insert 30 in a casing lid 31. The casing lid 31 is fixed to the front of the casing 1 by means of screws (not shown). The casing lid 31 has orifices 32 and 33 which are concentric with the suction orifices 6 and 7. The concrete coming out of the supply cylinders 8 and 9 flows through the orifices 32 and 33 and thence along a Y pipe 34 arranged outside on the casing lid 31 into a concrete-conveying pipe (not shown).

The concrete to be conveyed is passed to the pump by means of a preliminary feed receptacle 35, which is mounted on the casing 1 and which has a lower orifice 36 which is located over the two inlet orifices 4 and 5.

The bearing 37 for the oscillating shaft 11 of the valve body 10 is also mounted on the preliminary feed receptacle 35. The bearing 37 is a swing bearing which is sealed at 38 from the preliminary feed receptacle 35 and in which the oscillating shaft 11 can oscillate freely. As a result it lies outside the casing members which are under pressure from the pump and on one side near the oscillating body 10. The swing bearing allows the oscillating body 10 to adjust automatically according to the wear between the plate 16 and the wear insert 18 so that an optimum seal between the closing plate 16 and the wear insert 18 is given.

Since the side of the plate 16 facing the Y pipe 34 is constantly acted upon by the supply pressure while a slight pressure difference is continually applied on the other side owing to the suction process, the plate 16 is always pressed against the wear insert 18. At the same time the oscillating body 10 moves around the swing bearing 37. The front sides 26, 27 of the segments 22, 23 also move in a circular path, the center point of which is located in the swing bearing 37. So that the front edges 26 and 27 always abut the guide surface 28, the front edges 26 and 27 and the guide surface 28 have respective slanting surfaces 39 and 40 which correspond to the tangents to this circle (see FIG. 2).

In order to couple the oscillating body 10 to the shaft 11, a profiled ridge 41 is formed on the front surface of the shaft 11. This profiled ridge 41, which runs vertically according to the embodiment shown, engages in a groove 42 on the oscillating body 10.

The casing 1 is pivotally mounted in swing bearings 43 and 44. After releasing a wedge connection 45, the casing 1 can be pivoted around a shaft 46, whch runs parallel to the passages 2 and 3. Then all members, especially the closing elements, are freely accessible and can be replaced or adjusted.

In the embodiments shown in FIGS. 3 and 4 the oscillating body 10 has a single curved segment 47 concentric with the axis of rotation and forming a closing element, but two closing plates 48 and 49, which form a pair of closing elements, with which the pushing orifices are covered alternatively. Thus the segment 47 is disposed between the two closing plates 48 and 49.

In the embodiment shown in FIGS. 5 to 9 the casing members generally designated 1 are under pump pressure. An oscillating body 10, shown in perspective in FIG. 6, carries a plate 16 used as closing element for the pushing orifices of both supply cylinders 8 and 9 on the front side of the casing. The other two closing elements take the form of a curved plate 82 which is orthogonal to the plate 16 and concentric to the axis of the oscillating shaft 11. Closing elements 70 and 71 are located one on each side of a recess 51.

Figure 8:
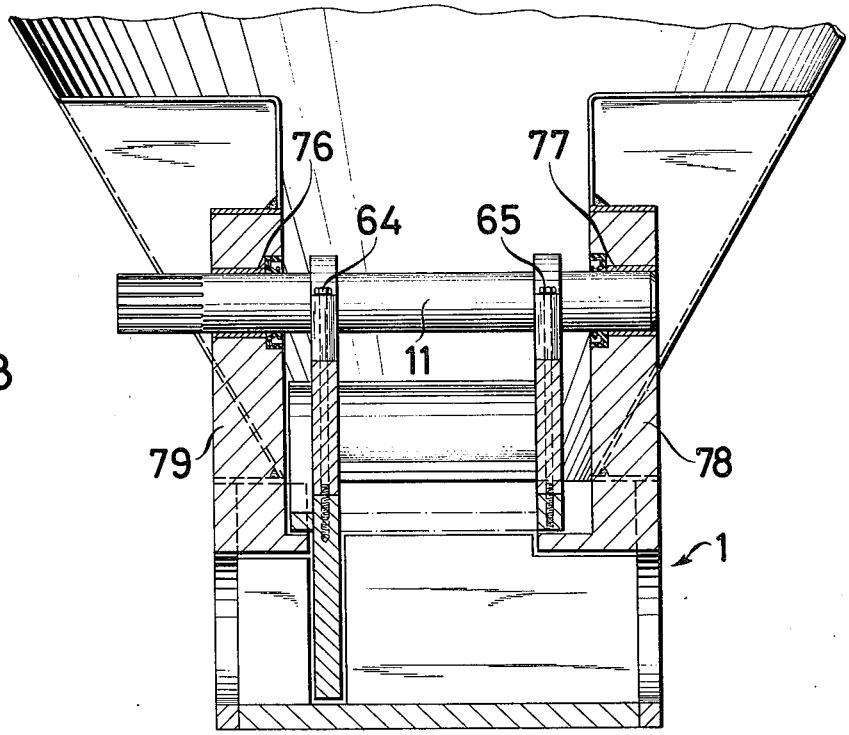
FIG. 8 is a longitudinal section through the distributing valve according to FIG. 5.

The plate 82 has four identical protrusions 52 to 55 for accommodating anchoring screws 64 and 65 (see FIG. 8). The heads of the anchoring screws 64 and 65 are seated above bore holes 62 and 63, which are set, one on each side of the oscillating shaft 11, in each of two support plates 72 and 73, which are clamped on the oscillating shaft 11. Two parallel plates 58 and 59, having bores 60 and 61 for accommodating the anchoring screws 64 and 65, are inserted as spacing members between the plate 82 of the oscillating body 10 and the support plates 72 and 73 respectively.

As can be seen, the plates 16 and 82 forming the closing elements both lie below the oscillating shaft 11, which is provided with splines 74 for the attachment of a drive mechanism. The closing elements 70 and 71 are formed in pairs and serve to control the suction orifice. Shaft bearings 76 and 77 are housed outside the parts of the casing 1 under pump pressure in two parallel plates 78 and 79 (see FIG. 8).

Releasing the anchoring screws 64 and 65, which are arranged on both sides of the shaft and therefore are present in duplicate, frees the plates 58 and 59, so that the oscillating body 10, of which the two plates 82 and 16 serve as closing members, can be assembled without the rotating shaft 11 having to be released from its bearings 76 and 77. Installation of the described members can be carried out in reverse manner.

Figure 9:
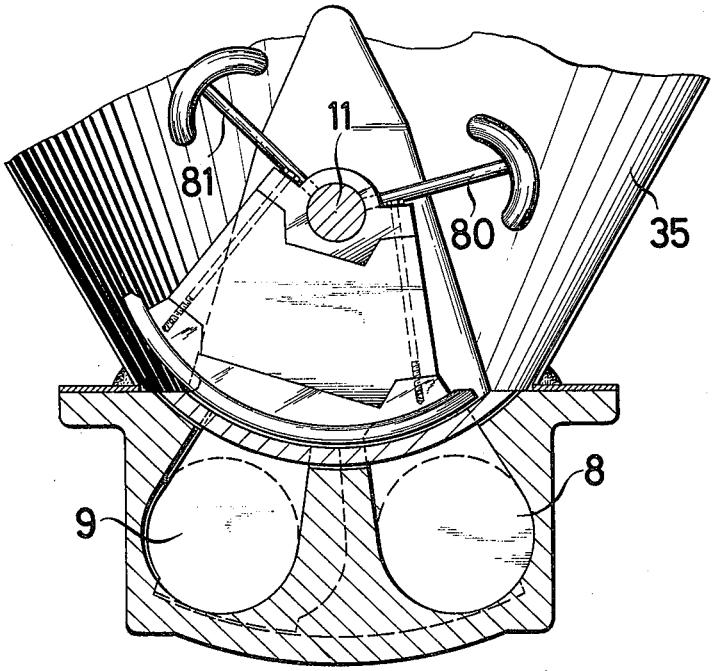
FIG. 9 is a cross-sectional view of the valve shown in FIG. 8.

As shown in FIG. 9, several paddles 80 and 81 are mounted on the rotating shaft in order to exploit the swing movement to produce a mixing effect in the preliminary feed receptacle 35 so that the concrete to be pumped does not solidify.

What is claimed is:

1. A distributing valve for use with twin cylinder pumps supplying viscous materials, such as concrete, each cylinder of said pump having a pressure orifice and a suction orifice, said valve comprising:

a casing connectable to the pump and having a portion which is subjected at least partially to the pressure to the pump;

a shaft journalled in said casing outside the portion subjected to the pump pressure for movement about an axis generally parallel to the cylinders; and an oscillating body coupled to, and adapted to be driven by, said shaft, said oscillating body having closing elements which alternately open the suction orifice of one of the pump cylinders and the pressure orifice of the other of the pump cylinders responsive to oscillatory movement of said body, said closing elements being arranged on the same side of the rotating shaft and including a pair of closing elements for either the suction orifices of the pressure orifices.

2. A distributing valve according to claim 1, wherein a single closing element is provided for the pressure orifices and a pair of closing elements for the suction orifices.

3. A distributing valve according to claim 1, wherein a single closing element is provided for the suction orifices and a pair of closing elements are provided for the pressure orifices.

4. A distributing valve according to claim 1, wherein the closing element or elements for the suction orifice are formed as a plate or plates or parts of a plate and are curved so as to be concentric with the axis of the oscillating shaft.

5. A distributing valve according to claim 1, wherein the closing element or elements for the pressure orifices are formed as flat plates and are connected to, or formed integrally with, the plate which forms the closing element or elements for the suction orifices.

6. A distributing valve according to claim 1, wherein the oscillating shaft is mounted in a swing bearing.

7. A distributing valve according to claim 1, wherein stops for the plates forming the closing elements are provided in the casing.

8. A distributing valve according to claim 7, wherein the stops are located on a wear insert which is arranged in front of the pressure orifices in the casing.

9. A distributing valve according to claim 1, wherein the oscillating body has a groove on its side facing the rotating shaft, said groove extending towards the center longitudinal plane, a profiled ridge formed on the front of the oscillating shaft being arranged to adjustably engage said groove.

10. A distributing valve according to claim 1, wherein the casing is pivotably mounted.

11. A distributing valve according to claim 1, wherein wear inserts or sealing edges are arranged in recesses in the casing without providing a firm stop for segments which slide thereon.

12. A distributing valve according to claim 1, wherein the oscillating body for connection to the oscillating shaft includes plate means forming the closing elements and at least one support plate having a releasable spacing member.

13. A distributing valve according to claim 1, wherein the rotating shaft is provided with paddles.

14. A distributing valve according to claim 1 wherein both ends of the rotating shaft are mounted in the portion of the casing which is not subjected to pump pressure.

* * * * *